US009165512B2

(12) United States Patent
Yu et al.

(10) Patent No.: US 9,165,512 B2
(45) Date of Patent: Oct. 20, 2015

(54) METHOD FOR REDUCING DOUBLE IMAGES

(75) Inventors: Shang-han Yu, Changhua (TW); Chi-chung Tsai, Jinhu Township, Kinmen County (TW); Yi-hsuan Cheng, Hsinchu (TW); Wen-chih Tai, Zhongli (TW)

(73) Assignee: CHUNGHWA PICTURE TUBES, LTD., Bade, Taoyuan (TW)

( * ) Notice: Subject to any disclaimer, the term of this patent is extended or adjusted under 35 U.S.C. 154(b) by 712 days.

(21) Appl. No.: 13/052,033

(22) Filed: Mar. 18, 2011

(65) Prior Publication Data

US 2012/0154343 A1 Jun. 21, 2012

(30) Foreign Application Priority Data

Dec. 16, 2010 (TW) ..... 099144254 A

(51) Int. Cl.
*G09G 3/36* (2006.01)
*G09G 3/34* (2006.01)

(52) U.S. Cl.
CPC ..... *G09G 3/3413* (2013.01); *G09G 3/3674* (2013.01); *G09G 2310/024* (2013.01); *G09G 2310/0235* (2013.01); *G09G 2320/0223* (2013.01)

(58) Field of Classification Search
CPC ..... G09G 3/3648; G09G 2320/103; G09G 2310/0205; G09G 2340/0435; G09G 3/3688; G09G 2330/021; G06F 1/08; H03K 5/13
USPC ..... 345/87–100, 204, 214
See application file for complete search history.

(56) References Cited

U.S. PATENT DOCUMENTS

| | | | | |
|---|---|---|---|---|
| 7,425,942 | B2 * | 9/2008 | Lee et al. | 345/99 |
| 7,518,587 | B2 * | 4/2009 | Lee et al. | 345/98 |
| 8,199,089 | B2 * | 6/2012 | Lin et al. | 345/87 |
| 8,253,673 | B2 * | 8/2012 | Hsu et al. | 345/92 |
| 8,305,323 | B2 * | 11/2012 | Lee et al. | 345/99 |
| 8,456,406 | B2 * | 6/2013 | Nam et al. | 345/100 |
| 2002/0196246 | A1 * | 12/2002 | Kanzaki et al. | 345/208 |
| 2007/0040795 | A1 * | 2/2007 | Lee et al. | 345/100 |
| 2009/0109197 | A1 | 4/2009 | Tu et al. | |
| 2009/0213056 | A1 * | 8/2009 | Nam et al. | 345/90 |
| 2009/0219242 | A1 * | 9/2009 | Fuchigami et al. | 345/100 |

FOREIGN PATENT DOCUMENTS

| | | | |
|---|---|---|---|
| TW | 200601250 | A | 1/2006 |
| TW | 200709145 | A | 3/2007 |
| TW | I283849 | | 7/2007 |
| TW | 200823844 | A | 6/2008 |

* cited by examiner

*Primary Examiner* — Kumar Patel
*Assistant Examiner* — Mansour M Said
(74) *Attorney, Agent, or Firm* — Cheng-Ju Chiang

(57) ABSTRACT

A method for reducing double images of a frame is disclosed. The frame is divided into a plurality of regions. The method includes generating a plurality of output enable (OE) signals, which are utilized to respectively adjust a plurality of conduction durations of a plurality of gate lines of the corresponding regions. The OE signals are outputted to a gate driver for generating a plurality of scan signals of the corresponding regions. The gate lines, which correspond to the regions, are driven by the gate driver according to the scan signals.

14 Claims, 14 Drawing Sheets

METHOD FOR REDUCING DOUBLE IMAGES

TECHNICAL FIELD OF THE INVENTION

The present invention relates to a method for reducing double images of a frame, and more particularly to a method for reducing the double images in different regions of the frame.

BACKGROUND OF THE INVENTION

With an advancement of display technology, an LCD drive speed increases faster and faster, in particular, color sequential display technology and three-dimensional (3D) display technology will have a higher requirement for the update speed of frames (frame rate).

As for the color sequential display technology, red, green, and blue (RGB) lights are used instead of a color filter in the color sequential display. In an orderly manner, an R field is scanned completely, and then the red light is illuminated. Next, a G field is scanned completely, and then the green light is illuminated. Finally, a B field is scanned completely, and then the blue light is illuminated. The RGB lights are illuminated according to the order for achieving the reproduction of colors. However, comparing with a conventional driving method, the conduction duration of a gate line is many times shorter. For example, a conventional frame rate is 60 Hz (for a period about 16.67ms), and the conduction duration of a gate line is about 16.67ms/total number of the gate lines. As for driving the color sequential display technology, the conduction duration of a gate line is about 16.67ms/(number of color field (at least three color field R, S, B)×total number of the gate lines).

While the conduction duration of the gate line is many times shorter than the original conduction duration, a resistance and capacitance delay (RC delay) phenomenon of the gate lines or data lines (source lines) will cause double images of the frame, also known as a ghost image. Referring to FIG. 1, FIG. 1 is a schematic drawing illustrating double images caused by an RC delay of a conventional display device. An example of a display device 10 with a resolution 1600×900 is described, and the display device 10 is utilized to show a frame 100. The display device 10 has a gate driver 200, a plurality of source drivers 300, 1600 vertically aligned data lines (not shown), and 900 horizontally aligned gate lines (not shown).

Referring to FIGS. 1 and 2A, FIG. 2A is a schematic drawing illustrating waveforms of signals for a region A of FIG. 1, where the abscissa represents time, and the ordinate represents signal level. In order to explain clearly, a clock signal (CLK), a data signal (D), a non-delayed scanning signal (S) and a delayed scanning signal (S') are depicted at different vertical positions. In the region A (indicated by a dashed region at upper right corner of FIG. 1) of the frame 100, the signal of the gate line (scanning signal) is transmitted from the left side to the right side of the display device, so the RC delay at the right side of the frame 100 is more serious. Thus, before the scanning signal of the Nth gate line (N ranges between 1 and 899) has not been completely turned off, the data signal of the (N+1)th gate line has begun to be written into the Nth gate line. Consequently, a liquid crystal capacitor which is located on the Nth gate line is charged by the data signal which should be provided to the (N+1)th gate line. This situation can easily cause an upper double image phenomenon, such as a faint and unclear image above the genuine image "A" shown in FIG. 1.

Referring to FIGS. 1 and 2B, FIG. 2B is a schematic drawing illustrating waveforms of signals for a region B of FIG. 1. In the region B (indicated by a dashed region at lower left corner of FIG. 1), due to a reduction of scanning time, the relationship between the data lines and the gate lines becomes more critical. The RC delay of the data line causes the delay of the data signal transmitted from the top to the bottom of the display device, as indicated by the delayed data signal shown in FIG. 2B for example. The data of the Nth gate line which delays transition is written into the front end of the (N+1)th gate line. This situation can easily cause a lower double image phenomenon, as a faint and unclear image below the current image "B" shown in FIG. 1.

Either the upper double image or the lower double image will cause a viewer discomfort. Therefore, there is a significant need to provide a method for reducing double images of a frame to solve the above-mentioned problems.

SUMMARY OF THE INVENTION

An objective of the present invention is to provide a method for reducing double images of a frame. The method can reduce the double images in different regions of the frame by inputting different output enable (OE) signals and/or different latch data signals according to the different regions.

To achieve the foregoing objectives, according to an aspect of the present invention, a method for reducing double images of a frame is provided. The frame is divided into a plurality of regions, also the frame is being provided by a display device. The display device has a gate driver, a plurality of source drivers, a plurality of data lines and a plurality of gate lines. The method includes: generating a plurality of OE signals for adjusting a plurality of conduction durations of the gate lines of the corresponding regions; outputting the OE signals to the gate driver to generate a plurality of scan signals of the corresponding regions; and driving the gate lines of the corresponding regions by the gate driver according to the scan signals.

In one preferred embodiment of the present invention, the OE signals are utilized to reduce the conduction durations of the gate lines of the corresponding regions, for example, delaying conducting and/or early shutting down the gate lines. In another embodiment, each of the OE signals is utilized to adjust the conduction durations of all the gate lines of one corresponding region among the regions. In still another embodiment, each of the OE signals is utilized to adjust a conduction duration of one corresponding gate line among the gate lines.

In yet another embodiment, the method further comprises: generating a plurality of latch data signals for adjusting data output time of the data lines of the regions; outputting the latch data signals to the source drivers for generating a plurality of pixel data signals of the corresponding regions; and driving the data lines of the corresponding regions by the source drivers according to the pixel data signals. Specifically, an adjustment of the data output time is done by delaying the data output time.

In addition, according to another aspect of the present invention, a method for reducing double images of a frame is provided. The frame is divided into a plurality of regions, also being provided by a display device. The display device has a gate driver, a plurality of source drivers, a plurality of data lines and a plurality of gate lines. The method includes: generating a plurality of latch data signals for adjusting a data output time of the data lines of the regions; outputting the latch data signals to the source drivers for generating a plurality of pixel data signals of the corresponding regions; and driving the data lines of the corresponding regions by the source drivers according to the pixel data signals. An adjustment of the data output time herein is done by delaying the data output time.

In another preferred embodiment of the present invention, the regions comprise a plurality of vertical regions of the frame. Each of the source drivers adjusts all the data lines of the corresponding regions according to the latch data signals of the corresponding latch data signals.

In still another embodiment, the method further comprises: generating a plurality of OE signals for respectively adjusting a plurality of conduction durations of the gate lines of the corresponding regions; outputting the OE signals to the gate driver for generating a plurality of scan signals of the corresponding regions; and driving the gate lines of the corresponding regions by the gate driver according to the scan signals.

Similarly, the OE signals are utilized to reduce the conduction durations of the gate lines of the corresponding regions. In yet another embodiment, each of the OE signals is utilized to adjust the conduction durations of all the gate lines of one corresponding region among the regions. In yet another embodiment, each of the OE signals is utilized to adjust a conduction duration of one corresponding gate line among the gate lines.

In accordance with the method for reducing the double images of the frame, the double images, which are caused by the RC delay of the gate lines and the data lines in different regions on the frame in the prior art, are improved by inputting different OE signals and/or different latch data signals according to the different regions. The images located on the various regions of the frame can be more elaborately adjusted.

It is to be understood that both the foregoing general description and the following detailed description of the present invention are exemplary and explanatory and are intended to provide further explanation of the invention as claimed.

DETAILED DESCRIPTION OF THE INVENTION

Figure 1:
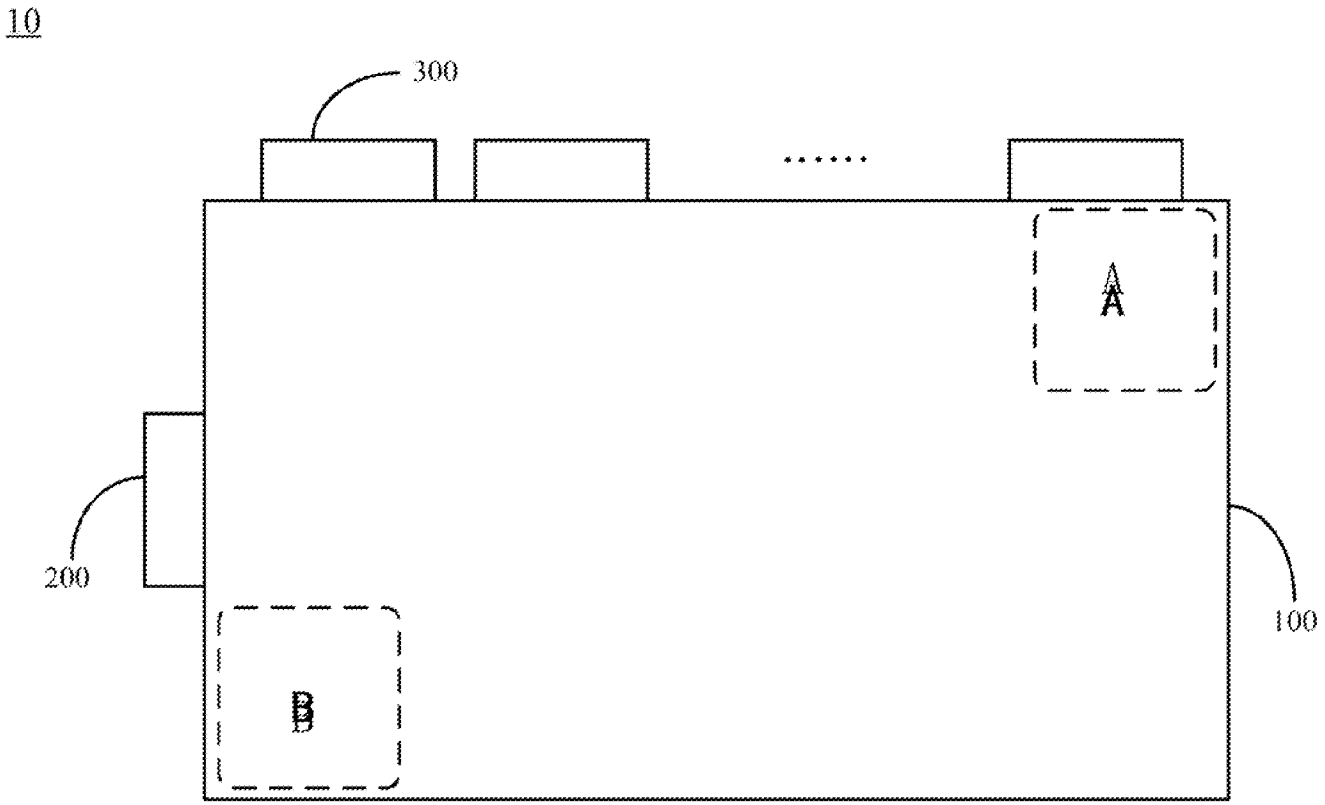
FIG. 1 (Prior art)
FIG. 1 is a schematic drawing illustrating double images caused by an RC delay on a conventional display device.
Figure 2B:
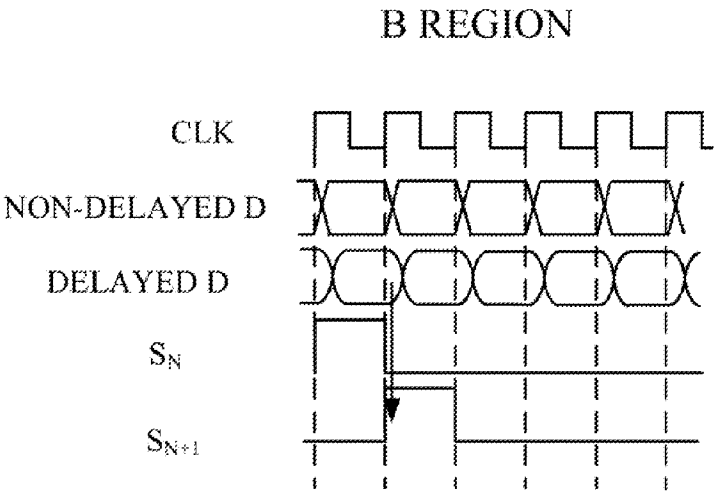
FIG. 2B (Prior art)
FIG. 2B is a schematic drawing illustrating waveforms of signals at B region of FIG. 1.
Figure 2A:
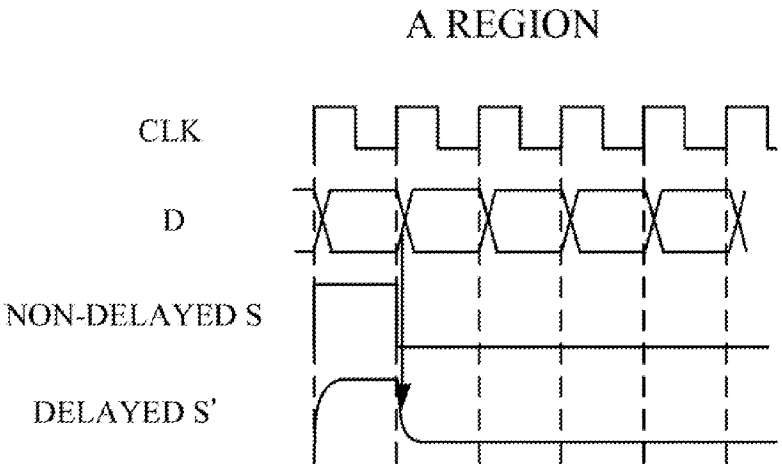
FIG. 2A (Prior art)
FIG. 2A is a schematic drawing illustrating waveforms of signals at A region of FIG. 1.

The specification of the present invention provides various embodiments to illustrate the technical features of the different implementation modalities of the present invention. The configuration of each component in the embodiments is utilized to clearly explain the contents of the present invention but not to limit the present invention. The same reference numerals refer to the same parts or like parts throughout the various figures, which do not mean the relationship between the various embodiments.

Figure 3:
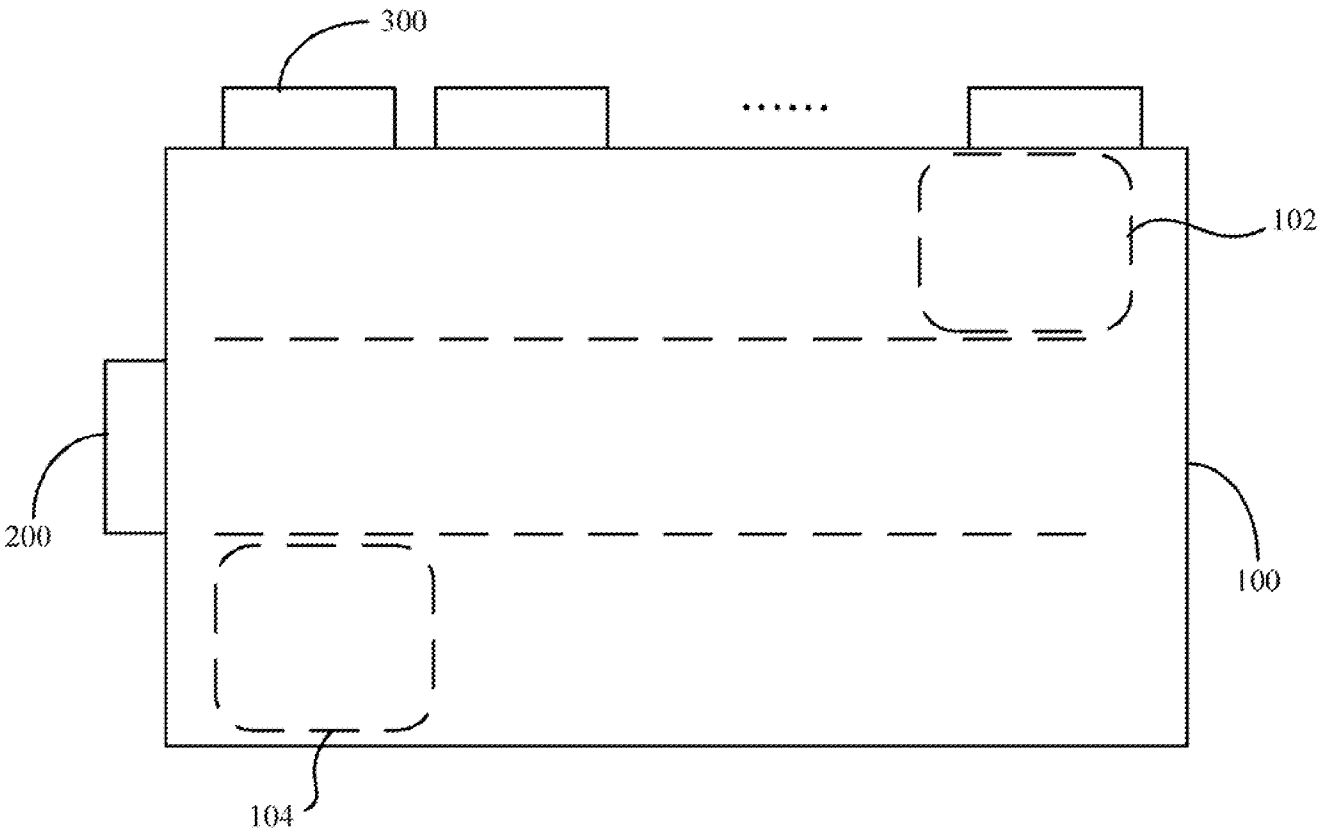
FIG. 3 is a top view schematically illustrating a display device in a first embodiment of the present invention.

Referring to FIG. 3, FIG. 3 is a top view schematically illustrating a display device in a first embodiment. An example using a frame 100 with a resolution 1600×900, where the frame 100 is divided into a plurality of regions, and the frame 100 is provided by a display device 10. The display device 10 has a gate driver 200, a plurality of source drivers 300, 1600 vertically aligned data lines (not shown), and 900 horizontally aligned gate lines (not shown). The frame 100 has a first region 102 and a second region 104 which have more serious double image. More specifically, The frame 100 can be simply divided into three equal portions, where the first to the 300th gate lines are located in a first equal portion of the frame 100, and the 301st the to the 600th gate lines are located in a second equal portion of the frame 100, and the 601st the to the 900th gate lines are located in a third equal portion of the frame 100. However, the frame 100 of the present invention is not limited to be divided into three equal portions, such that the frame 100 can be further divided into more equal portions. In addition, the frame 100 of the present invention is not limited to be divided into the equal portions, such that the frame 100 can also be implemented to divide into unequal-sized portions.

Figure 4:
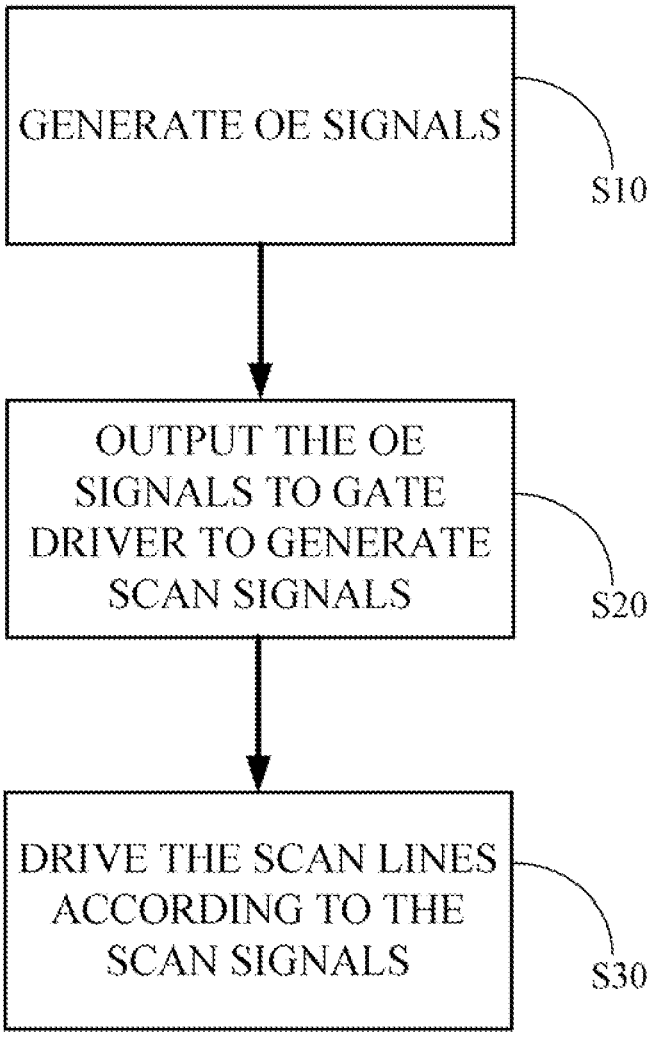
FIG. 4 is a flow chart illustrating a method for reducing the double images of the frame according to the first preferred embodiment of the present invention.

Referring to FIGS. 3 and 4, FIG. 4 is a flow chart illustrating a method for reducing the double images of the frame 100 according to the first preferred embodiment of the present invention. The method begins with step S10.

At step S10, a plurality of output enable (OE) signals are generated. The OE signals are utilized to respectively adjust a plurality of conduction durations of the gate lines of the corresponding regions (such as the first region 102 and the second region 104), and more particularly to adjust the conduction durations of the gate lines according to the reduction of the double images in the first region 102 and the second region 104. In the preferred embodiment, the adjustment of the conduction durations is implemented by reducing the conduction durations.

At step S20, the OE signals are outputted to the gate driver 200 to generate a plurality of scan signals of the corresponding regions (such as the first region 102 and the second region 104).

Figure 5A:
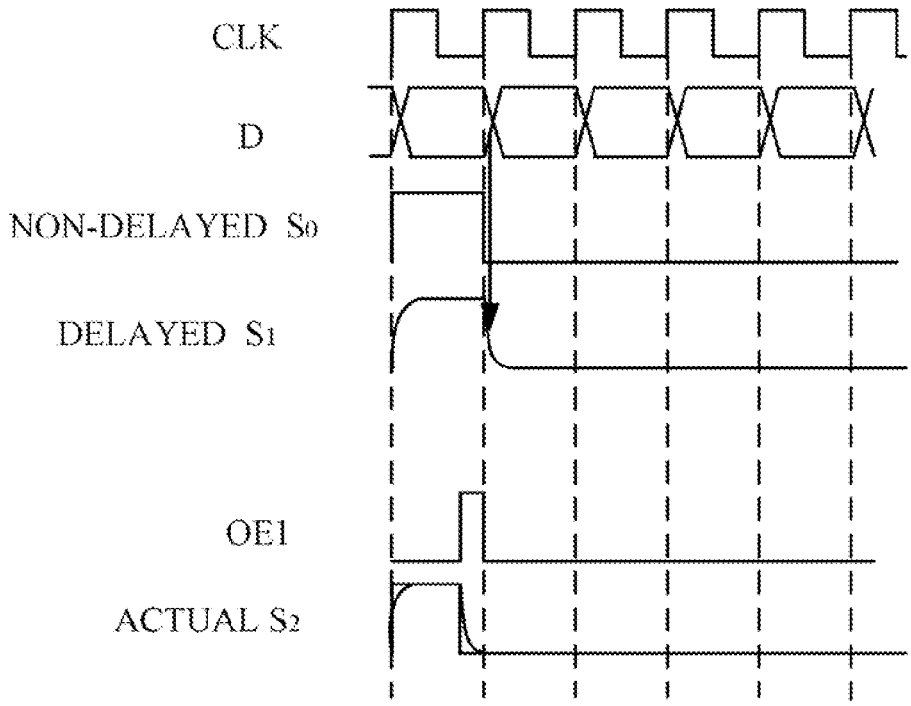
FIG. 5A is a schematic drawing illustrating waveforms of signals at the first region of FIG. 3.

Referring to FIG. 5A, FIG. 5A is a schematic drawing illustrating waveforms of signals at the first region 102 of FIG. 3. In order to explain clearly, a clock signal (CLK), data signal (D), non-delayed scanning signal ($S_0$), delayed scanning signal ($S_1$), OE signal (OE1), and actual scanning signal ($S_2$) are depicted in different vertical positions. The OE signals are provided to the gate driver 200 by a time controller (TCON) (not shown), and the OE signals are utilized to control the conduction durations of the gate lines.

The OE signals can be configured to make the corresponding gate line turned off when the OE signals are at a high level. Similarly, the OE signals also can be configured to make the corresponding gate line conduct when the OE signals are at a high level. In the preferred embodiment, the OE signal OE1 can be configured to make the corresponding gate line turned off when at the high level.

In the first region 102 of the frame 100, the RC delay of the gate lines is more serious, the scanning signal which is transmitted to the first region 102 is shown as the delayed scanning signal ($S_1$), which has be a delay of tail. Thus, the step of reducing the conduction durations is done by early shutting down the gate lines. The OE signals OE 1 is set to the high level at the later period of the conduction of the gate line, thereby early shutting down the gate line, which is shown as the actual scanning signal ($S_2$). Thus, the RC delay (i.e., at the tail end of the signal) of the gate line is suppressed earlier. Consequently, the pixels corresponding to the gate line will not be written into the next data signal, and the upper double image of the first region 102 is reduced.

Figure 5B:
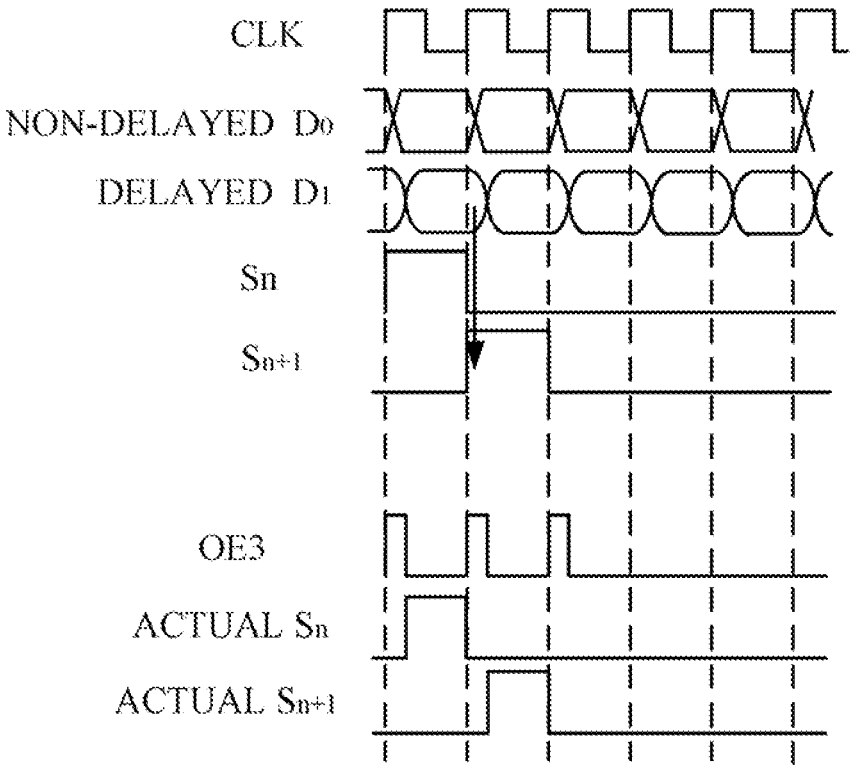
FIG. 5B is a schematic drawing illustrating waveforms of signals at the second region of FIG. 3.

Referring to FIG. 5B, FIG. 5B is a schematic drawing illustrating waveforms of signals at the second region 104 of FIG. 3. Similarly, clock signal (CLK), non-delayed data (source) signal (designated as non-delayed $D_0$), delayed data signal (delayed $D_1$), scanning signal of gate line N (Sn), scanning signal of gate line N+1 ($S_{n+1}$), OE signals (OE3), actual scanning signal (Sn) of gate line N(actual $S_n$), and actual scanning signal $S_n$ of gate line N+1 (actual $S_{n+1}$) are depicted in different vertical positions. In the preferred embodiment, the OE signal OE3 can be configured to make the corresponding gate line turned off when at the high level.

In the second region 104 of the frame 100, the RC delay of the data lines is more serious, the data signal which is transmitted to the second region 104 is shown as the delayed data signal $D_1$. Thus, the step of reducing the conduction durations is done by delaying conducting the gate lines. The OE signals OE 3 is set to a high level at the early period of the conductions of the gate lines, thereby conducting the gate lines late, which are shown as the actual scanning signal of gate line N (actual $S_n$, and the actual scanning signal of gate line N+1 (actual $S_{n+1}$). Thus, the gate line N+1 is not written in the delayed data signal ($D_1$). Consequently, the pixels corresponding to the gate line N+1 will not be written into the previous data signal, and the lower double image of the second region 104 has been reduced.

Figure 6:
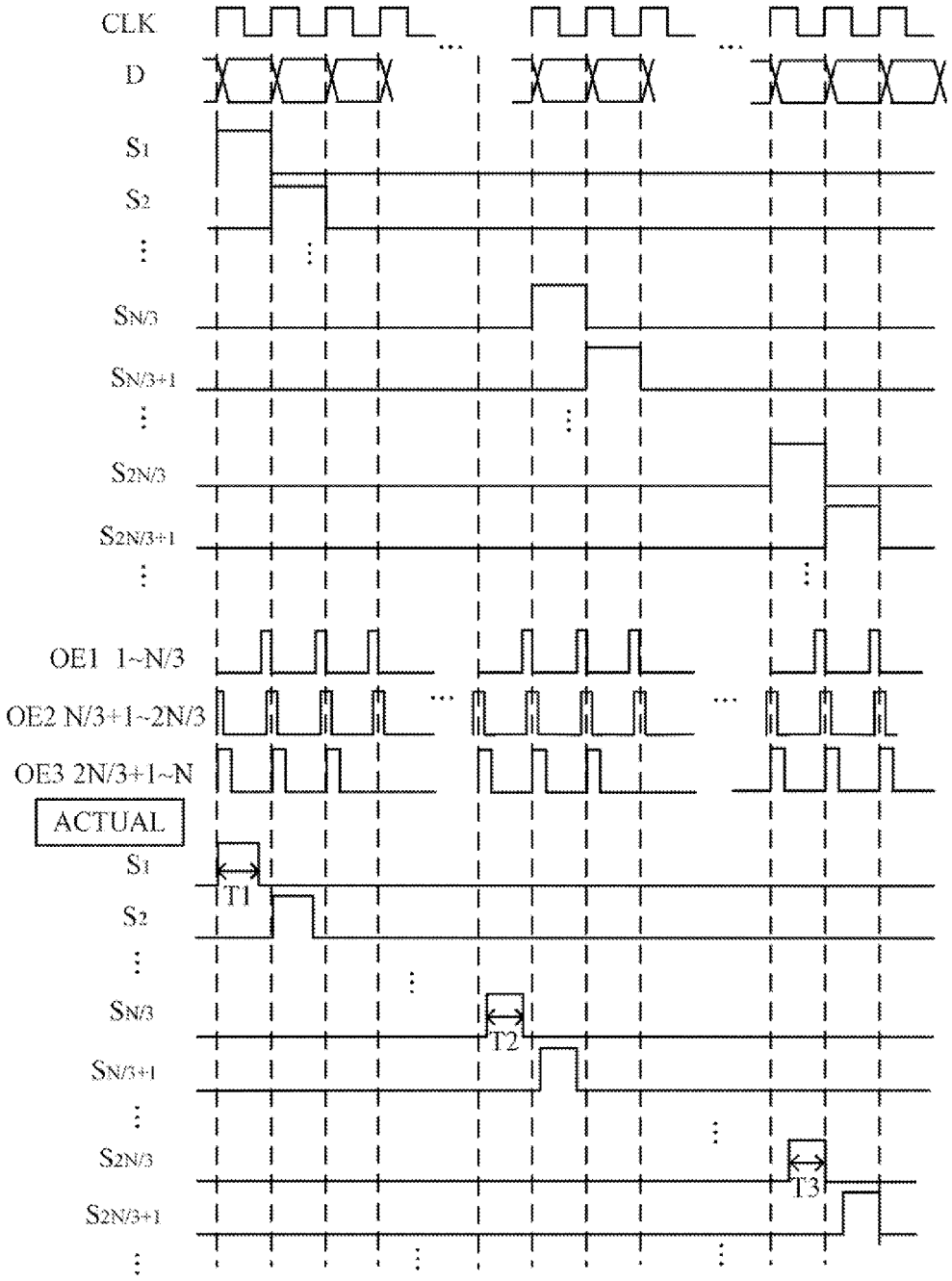
FIG. 6 is a schematic drawing illustrating waveforms of signals at three equal portions in the first embodiment.

Referring to FIGS. 3 and 6, FIG. 6 is a schematic drawing illustrating waveforms of signals at three equal portions in the first embodiment. Each of the OE signals is utilized to adjust the conduction duration of all the gate lines of one corresponding region among the regions. For instance, the frame 100 is divided into three equal portions, and the "N" represents the number of all the gate lines, such as 900 gate lines. The OE signals (OE) include OE1, OE2 and OE3, in which OE1 is utilized to adjust the conduction duration of the gate lines 1 to 300 corresponding to the first equal portion, OE2 is utilized to adjust the conduction duration of the gate lines 301 to 600 corresponding to the second equal portion, and OE3 is utilized to adjust the conduction duration of the gate lines 601 to 900 corresponding to the third equal portion of the frame 100. The OE signals OE1, OE2 and OE3 respectively correspond to the gate lines of the regions. A reduction of the double image of the first equal portion (especially a first region 102) of the frame 100 is explained as illustrated in FIG. 5A. The OE signal provided to the gate lines 1 to 300 is shown as OE1, which is utilized to early shut down the gate lines 1 to 300 for reducing the upper double image.

Similarly, a reduction of the double image of the third equal portion (especially a second region 104) of the frame 100 is explained as illustrated in FIG. 5B. The OE signal provided to the gate lines 601 to 900 is shown as OE3, which is utilized to delay turn on the gate lines 601 to 900 for reducing the lower double image.

The double image of the second equal portion of the frame 100 is between the upper double image of the first equal portion and the lower double image of the third equal portion; Thus, the gate lines 301 to 600 are required to turn on late and shut down early, thereby reducing the double image of the second equal portion. Accordingly, the OE signal provided to the gate lines 301 to 600 is shown as OE2, which is utilized to turn on late and shut down early the gate lines 601 to 900 for reducing the corresponding conduction durations.

At step S30, the gate lines of the corresponding regions are driven by the gate driver 200 according to the scan signals. It should be noted that the actual signals (actual $S_1$ to $S_N$) of gate lines 1 to 900 are modulated by the OE signals. The conduction duration of the gate lines 1 to 300 are shortened as T1, and the conduction duration of the gate lines 301 to 600 are shortened as T2, and the conduction duration of the gate lines 601 to 900 are shortened as T3, which the T1, T2 and T3 are preferably the same.

Figure 7:
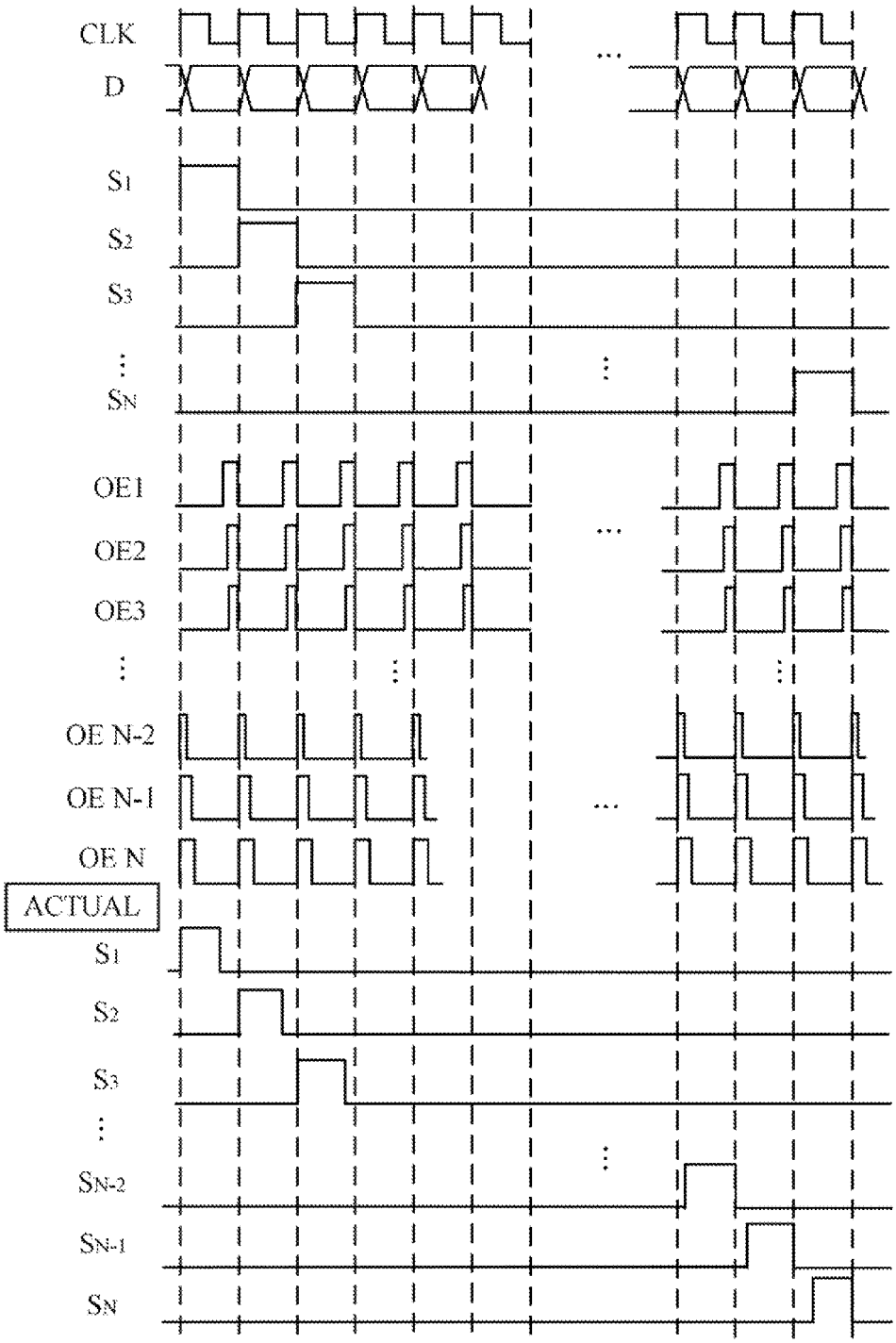
FIG. 7 is a schematic drawing illustrating waveforms of each scan signal in the first embodiment.

It is understandable that the method of the present invention for reducing the double images of the frame is not limited to the frame 100 being divided into three equal portions, and it also can be divided into five, ten, and more equal portions to precisely adjust the double images of each region. For an extreme example, each of the OE signals is utilized to adjust a conduction duration of one corresponding gate line among the gate lines. Specifically, the frame 100 can be divided into the regions corresponding to the respective gate lines, that is, the frame 100 can be divided into N regions where the N is the total number of all gate lines. Furthermore, an individual OE signal is provide to each gate line so as to reduce the double image of each gate line, and those OE signals are utilized to adjust the conduction duration of each gate line in accordance with reducing the double image of each gate line. Referring to FIG. 7, FIG. 7 is a schematic drawing illustrating waveforms of each the scan signal in the first embodiment. In the embodiment, "N" is 900, and thus the original signals (S1 to SN) of the gate lines 1 to 900 (i.e., N) make the conduction duration of the gate lines 1 to 900 be a complete period of the clock signal (CLK).

Similarly, there are also nine hundred OE signals being provided at step S10 as well, such as OE1, OE2, . . . , OE900, wherein each of the OE signals respectively corresponds to the gate lines. At step S20, the OE signals OE1 OE2 . . . OE900 are outputted to the gate driver 200 to generate an actual scanning signal ($S_1$) corresponding to the gate line 1, an actual scanning signal ($S_2$) corresponding to the gate line 2, . . . an actual scanning signal ($S_N$) corresponding to the gate line N. At step S30, the regions (the 900 region) of the gate line 1, the gate line 2, . . . the gate line N are driven by the gate driver 200 according to the actual scanning signal ($S_1$), the actual scanning signal ($S_2$), . . . the actual scanning signal ($S_N$).

Figure 8A:
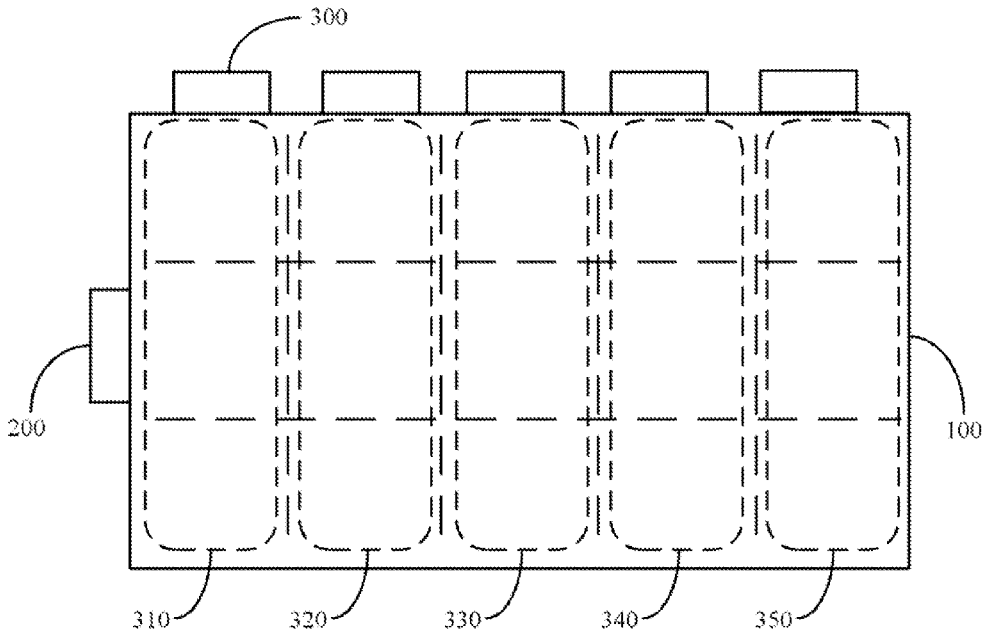
FIG. 8A depicts an increasing vertical partition in the horizontally equal portion of the frame.

In the first embodiment, except for the frame 100 being divided into several horizontal regions, the frame 100 also can be divided into several vertical regions for a more precisely adjustment. Referring to FIG. 8A, FIG. 8A depicts an increased vertical partition in the horizontally equal portions of the frame 100. In the embodiment, the display device has five source drivers 30, so the vertical partitions are classified into a first partition 310 to a fifth partition 350.

Accordingly, in the first embodiment, the method for reducing the double images of the frame further includes generating a plurality of latch data (LD) signals for respectively adjusting data output time of the data lines of the corresponding regions. The latch data signals are outputted to the source drivers 300 to generate a plurality of pixel data signals of the corresponding regions. Finally, the data lines of the corresponding regions are driven by the source drivers 300 according to the pixel data signals.

Figure 9B:
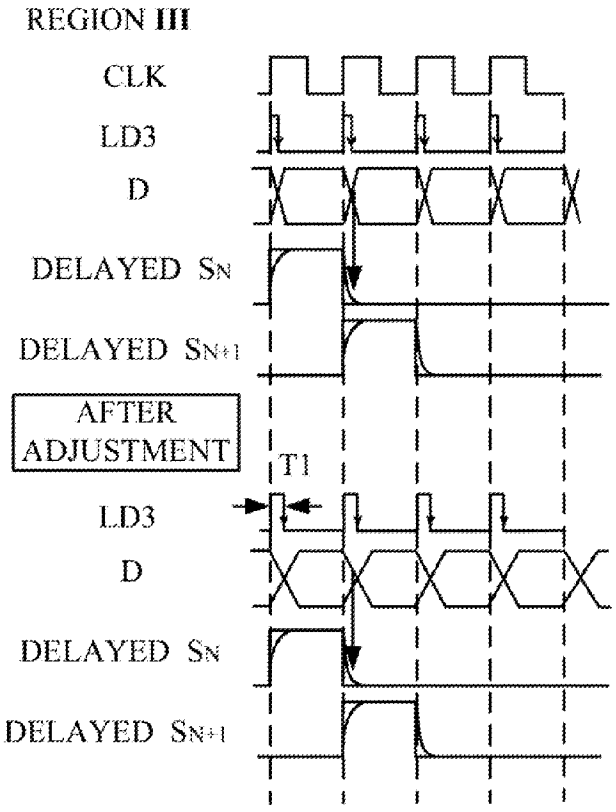
FIG. 9B is a schematic drawing illustrating waveforms of signals at third partition of FIG. 8A.
Figure 9A:
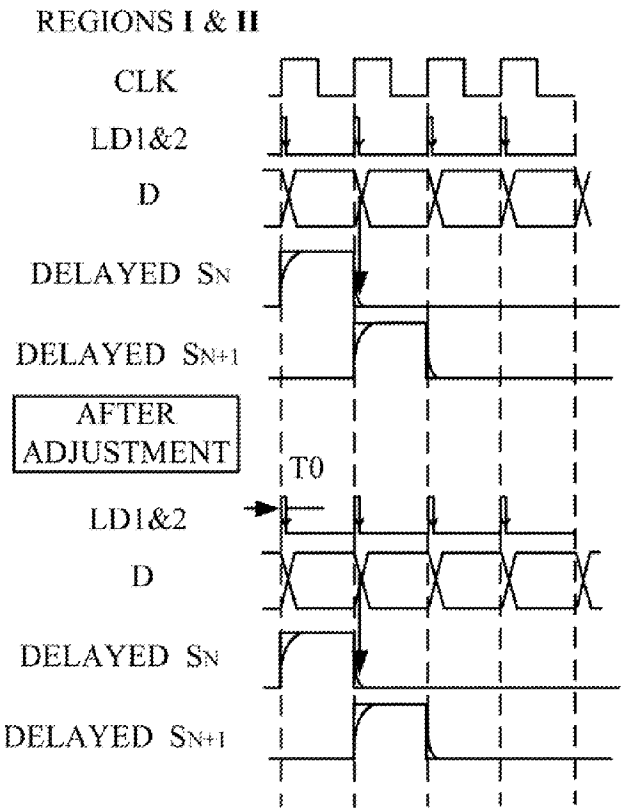
FIG. 9A is a schematic drawing illustrating waveforms of signals at first and second partitions of FIG. 8A.
Figure 9D:
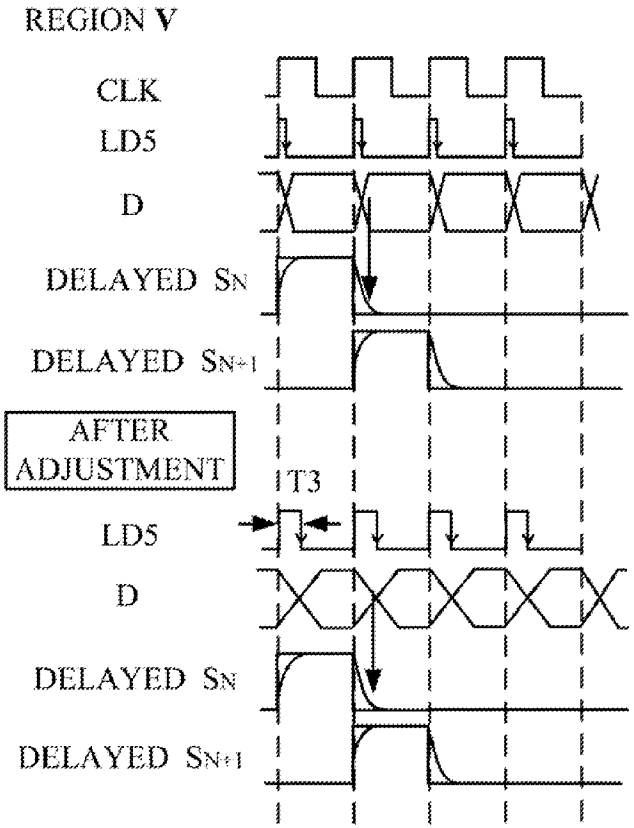
FIG. 9D is a schematic drawing illustrating waveforms of signals at fifth partition of FIG. 8A.
Figure 9C:
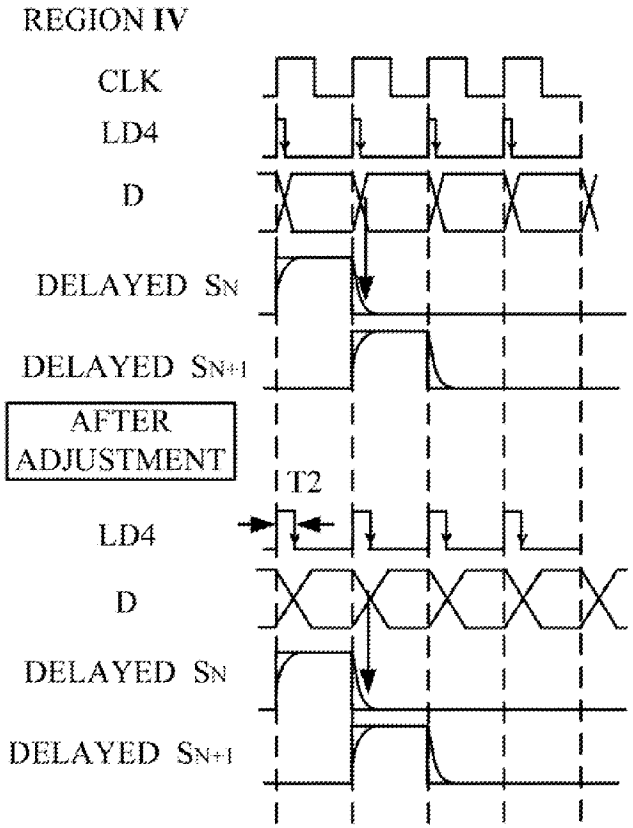
FIG. 9C is a schematic drawing illustrating waveforms of signals at fourth partition of FIG. 8A.

Referring to FIGS. 9A to 9D, FIG. 9A is a schematic drawing illustrating waveforms of signals at first and second partitions of FIG. 8A; FIG. 9B is a schematic drawing illustrating waveforms of signals at third partition of FIG. 8A; FIG. 9C is a schematic drawing illustrating waveforms of signals at fourth partition of FIG. 8A; and FIG. 9D is a schematic drawing illustrating waveforms of signals at fifth partition of FIG. 8A. Specifically, the latch data signals are provided to the source drivers 300 by the time controller (TCON) (not shown). When the source drivers 300 transform data into control signals (digital to analog), and when the latch data signals are at a falling edge, the source drivers 300 are triggered for outputting the levels which are corresponding to the data.

The frame 100 is divided into five partitions. The RC delay of the gate lines closer to the fifth partition 350 are more serious, and the order of severity is fifth partition 350>fourth partition 340>third partition 330>second partition 320>first partition 310. Thus, the latch data signals of the source drivers 300 are respectively divided into LD1 to LD5 for individually controlling the partitions, which is illustrated as follows.

Referring to FIG. 9A, on the first partition 310 and the second partition 320, because the partitions are closer to the gate driver 200, the RC delay of the gate lines is less obvious (shorter tail). Consequently, the falling edge times of the LD1 and LD2 are set to T0, thereby controlling to emit the corresponding levels of the data lines of the first partition 310 and second partition 320 at the beginning of the pulse period.

Referring to FIG. 9B, on the third partition 330, the RC delay of the gate lines is gradually obvious. Consequently, the falling edge time of the LD3 is set to T1, thereby controlling to emit the corresponding levels of the data lines of the third partition 330 at T1 after the beginning of the pulse period.

Referring to FIG. 9C, on the fourth partition 340, the RC delay of the gate lines is more obvious. Consequently, the falling edge time of the LD4 is set to T2, thereby controlling to emit the corresponding levels of the data lines of the fourth partition 340 at T2 after the beginning of the pulse period.

Referring to FIG. 9D, on the fifth partition 350, the RC delay of the gate lines is more obvious. Consequently, the falling edge time of the LD5 is set to T3, thereby controlling to emit the corresponding levels of the data lines of the fifth partition 350 at T3 after the beginning of the pulse period. The relationship between the delayed falling edges is the T3>T2>T1>T0, which are adjusted till the upper double images disappear. In short, the latch data (LD) signals is utilized to delay output periods of the data signals so as to match the delayed the gate lines for reducing the double images.

Figure 8B:
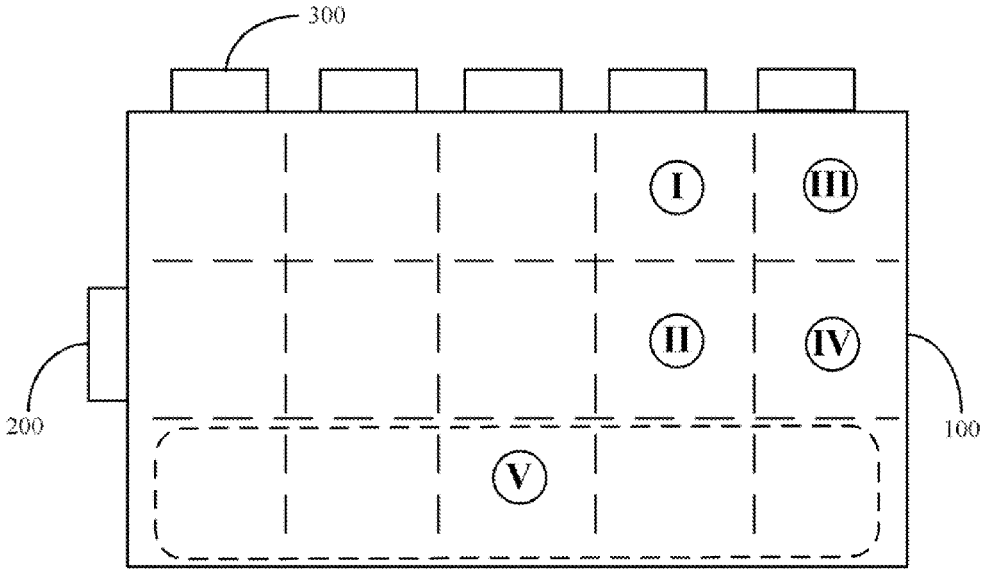
FIG. 8B is a schematic drawing illustrating regions of FIG. 8A.

It can be seen from the foregoing that the method of the present invention for reducing the double images of the frame can employ the latch data (LD) signals and the OE signals at the same time to improve the double images of the frame in the partitions manner. Referring to FIG. 8B, FIG. 8B is a schematic drawing illustrating regions of FIG. 8A. Due to the RC delay of the gate lines, the double images appear more easily on the regions I, II, III and IV of FIG. 8B. Thus, the LD4 and LD5 of the fourth partition 340 and the fifth partition 350 (Shown as FIG. 8A) can be controlled so as to make the delayed gate line "N" keep the data of Nth before the delayed gate line "N" shutting down, so as not to write into transitional data of N+1th shown in the waveforms of signals in FIGS. 9C and 9D.

Figure 10:
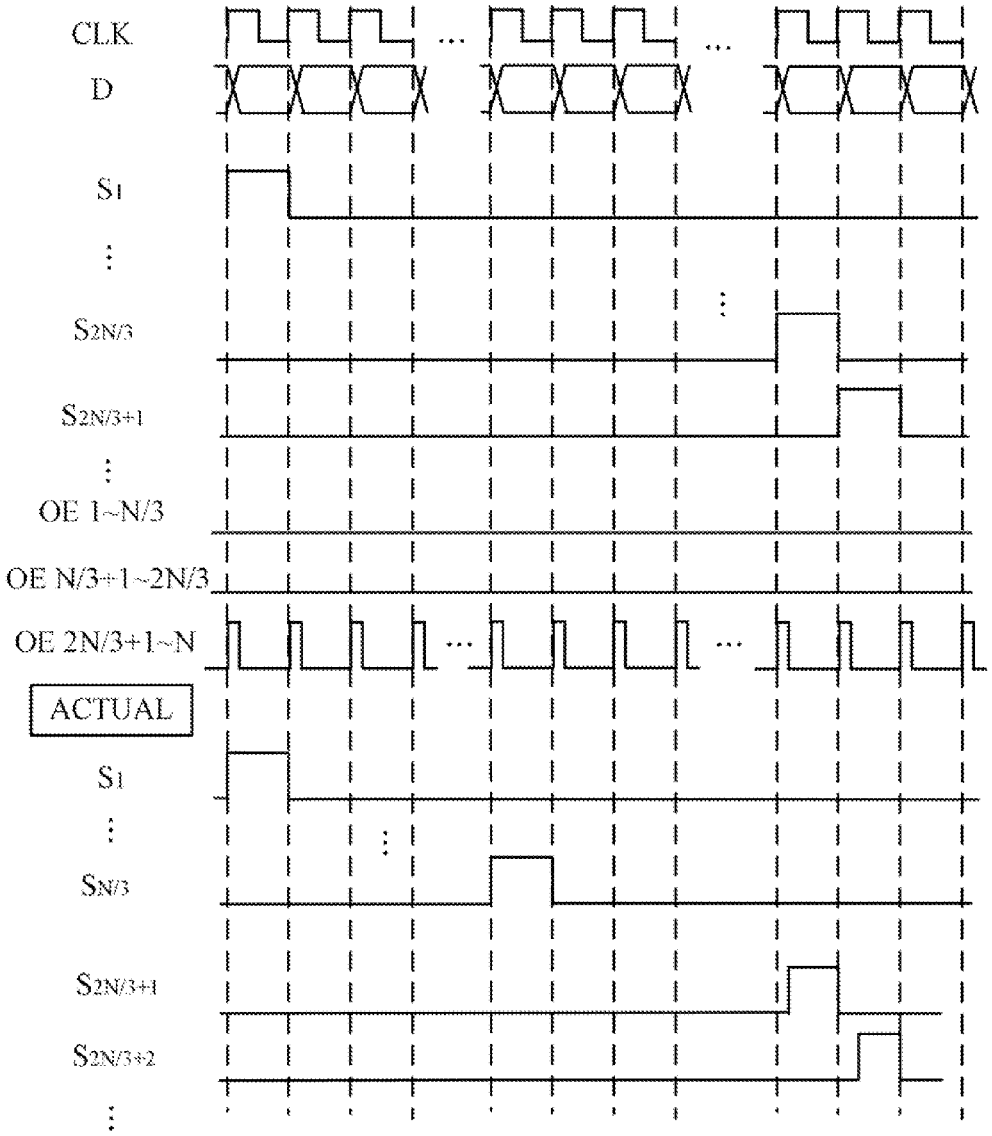
FIG. 10 is a schematic drawing illustrating waveforms of the scan signals of FIG. 8B.

On the region V of FIG. 8, the OE signals can be utilize to reduce the lower double image on the region V. Referring to FIG. 10, FIG. 10 is a schematic drawing illustrating waveforms of the scan signals of FIG. 8B. The region V is located in the third equal portion, so the desired OE signal of region V (the gate lines are 2N/3+1~N, such as 601 to 900) is the OE3 shown as the OE3 in FIG. 6. Thus, the original scan signals ($S_{2N/3+1}$ to $S_N$) are modulated as the actual scan signals ($S_{2N/3+1}$ to $S_N$), which is utilized to delay the conductions of the gate lines 601 to 900 for reducing the lower double image.

The double images of the region I, II, III, IV have been reduced by controlling the latch data (LD) signals, so the gate lines of the first and the second equal portions on the frame 100 are no longer to be modulated by the OE signals. Specifically, OE1 to OE 2N/3 are all at low level, so the waveforms of the actual scan signals 1 to 2N/3 are the same as the original. It should be noted that the present invention is not limited to be implemented in said partitions, and the frame 100 can also be divided into more regions for more precisely adjustments.

In summary, the method for reducing the double images of the frame according to the first embodiment of the present invention employs the plurality of OE signals to respectively improve the double image of the various regions of the frame. What is more, the OE signals having the same number of the gate lines are provided to reduce the double image of each can line. In addition, the method for reducing the double images of the frame according to the first embodiment also combines the step of generating the plurality of latch data signals to adjust various vertical regions of the frame, and the problem of the RC delay of the gate line and the data line is overcome completely.

What follows is a second embodiment of the method for reducing the double images of the frame according to the present invention. In contrast with the first embodiment, the frame 100 is divided into a plurality of vertical regions in the second embodiment, and then using said latch data (LD) signals to control the signal of the data lines of the regions for reducing the double images of parts of the regions. Furthermore, the frame 100 can be divided into a plurality of horizontal regions, and then using said OE signals to control the scan signals for reducing the double images of the other regions. The overlap with the first embodiment won't go into detail herein.

Figure 11:
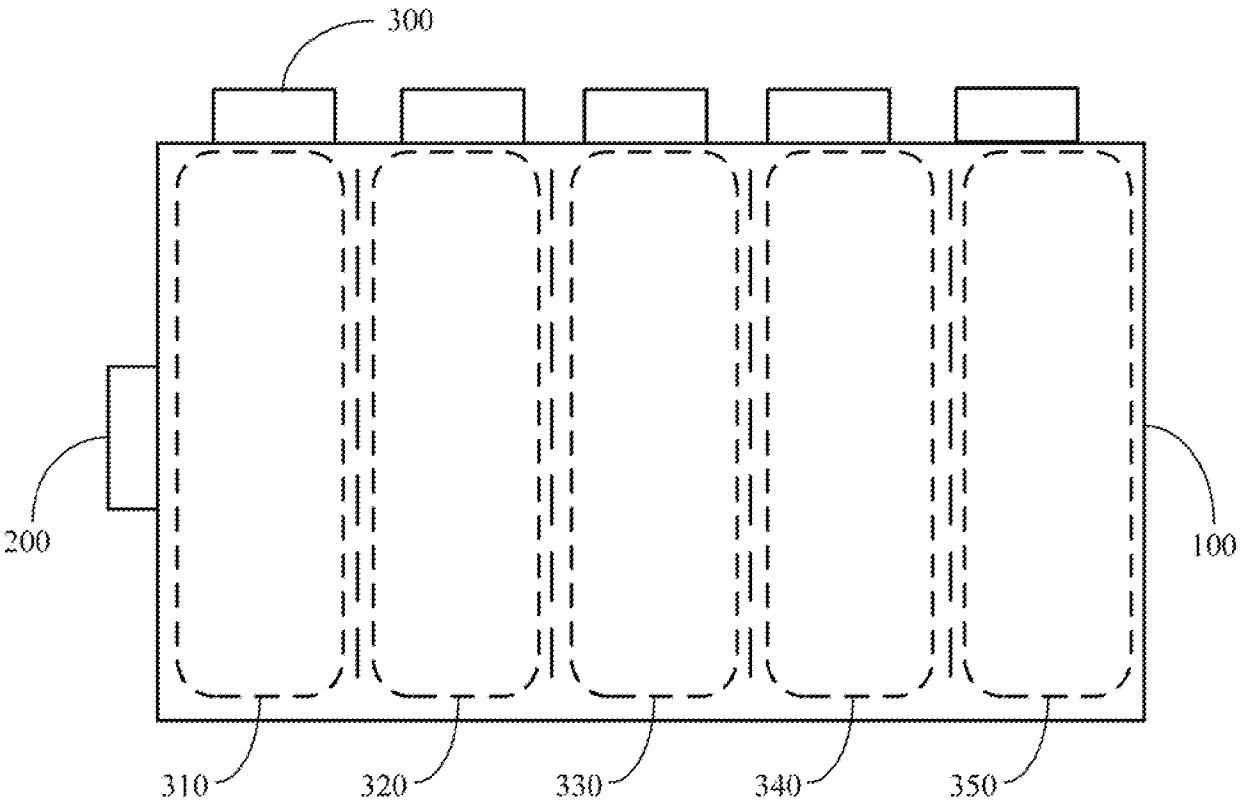
FIG. 11 is a top view schematically illustrating a display device in a second embodiment.

Referring to FIG. 11, FIG. 11 is a top view schematically illustrating a display device in a second embodiment. Similarly, using a frame 100 with a resolution 1600×900 as an example, the frame 100 is divided into a plurality of regions, in particular vertical regions, and the frame 100 is being provided by a display device 10. The display device 10 has a gate driver 200, a plurality of source drivers 300, 1600 vertically aligned data lines (not shown), and 900 horizontally aligned gate lines (not shown). In the embodiment, the display device has five source drivers 30, so the frame 100 is divided into first partition 310 to the fifth partition 350 for respectively corresponding to said source drivers 300.

Figure 12:
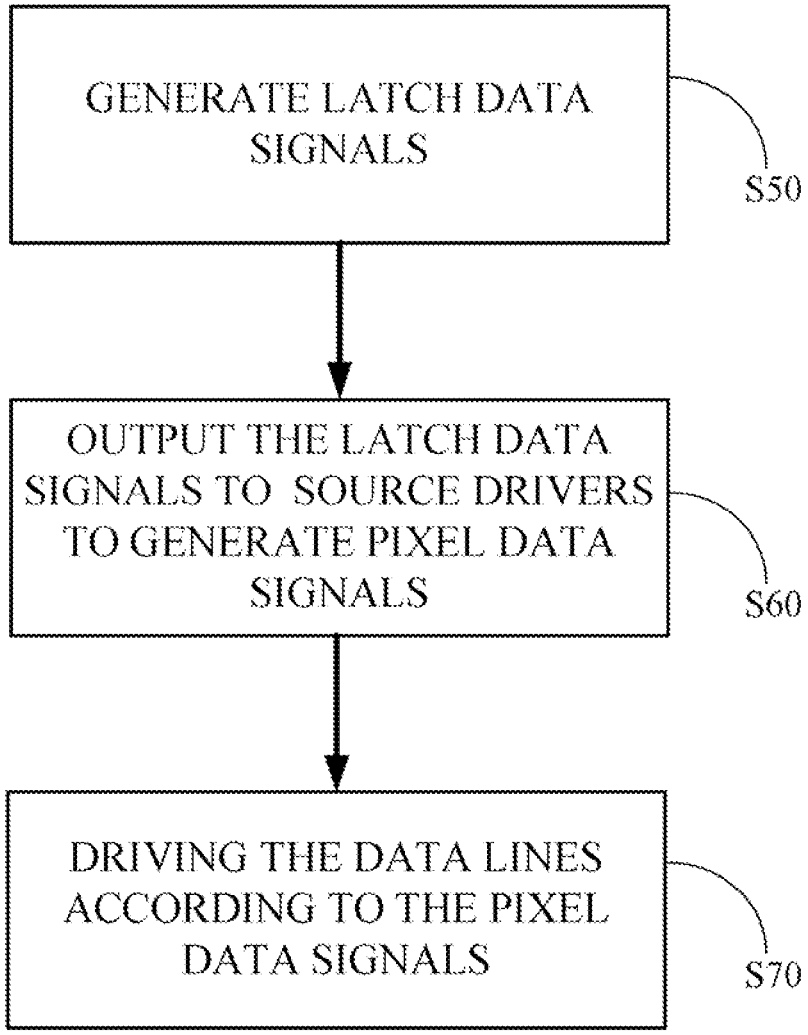
FIG. 12 is a flow chart illustrating a method for reducing the double images of the frame 100 according to the second preferred embodiment of the present invention.

Referring to FIG. 12, FIG. 12 is a flow chart illustrating a method for reducing the double images of the frame 100 according to the second preferred embodiment of the present invention. The method begins with step S50.

At step S50, a plurality of latch data signals are generated, which the latch data signals are utilized to respectively reduce the double image of the regions, such as the first partition 310 to the fifth partition 350. The latch data signals are utilized to adjust a plurality of data output time of the data lines of the corresponding regions, in particular to delay the data output time. The details can refer to the explanation of FIGS. 9A to 9D.

At step S60, the latch data signals are outputted to the source drivers 300 to generate a plurality of pixel data signals of the corresponding regions. Each of the source drivers 300 adjust all the data lines located in one corresponding region according to a corresponding latch data signal among the latch data signals. In short, each source driver 300 corresponds to one of the latch data signals which are utilized to adjust all the data lines located in the corresponding region.

At step S70, the data lines of the corresponding regions are driven by the source drivers 300 according to the pixel data signals. The source drivers 300 herein are respectively drive the data lines located in the first partition 310 to the fifth partition 350.

In the second embodiment, except for the frame 100 being divided into several horizontal regions, the frame 100 also can be divided into several vertical regions for the more precisely adjustment. Referring to FIGS. 8A and 8B, as mentioned above, the frame 100 can be simply divided into three equal portions again, where the first to the 300th gate lines are located in a first equal portion of the frame 100, and the 301st the to the 600th gate lines are located in a second equal portion of the frame 100, and the 601st the to the 900th gate lines are located in a third equal portion of the frame 100. However, the frame of the present invention is not limited to be divided into three equal portions, such that the frame 100 can be further divided into more equal portions. It can be seen from the foregoing that the method for reducing the double images of the frame of the present invention can employ the latch data (LD) signals and the OE signals at the same time to improve the double images of the frame in the partitions.

Therefore, the method for reducing the double images of the frame according to the second embodiment further includes generating a plurality of OE signals for respectively adjusting a plurality of conduction durations of the gate lines of the corresponding regions. Subsequently, the OE signals are outputted to the gate driver 200 to generate a plurality of scan signals of the corresponding regions. Finally, the gate lines of the corresponding regions are driven by the gate driver 200 according to the scan signals. Using the OE signals to reduce the double images of the regions has been explained above, so we won't go into detail herein.

Similarly, the OE signals are utilized to reduce the conduction durations of the gate lines of the corresponding regions. In another embodiment, each of the OE signals is utilized to adjust the conduction durations of all the gate lines of one corresponding region among the regions, as shown on the region V of FIG. 8. In still another embodiment, each of the OE signals is utilized to adjust a conduction duration of one corresponding gate line among the gate lines. For instance, each of the gate lines on the region V of FIG. 8 are inputted an individual OE signal to respectively adjust each gate line, as shown in FIG. 7.

In summary, the method for reducing the double images of the frame according to the second embodiment of the present invention employs the plurality of latch data signals for respectively transmitting to each source driver 300, thereby improving the double images of the various vertical regions of the frame 100. In addition, the method for reducing the double images of the frame according to the second embodiment also combines the step of generating the plurality of OE signals to adjust the various horizontal regions of the frame 100, and the problems of the upper double image and the lower double image of the vertical regions due to the RC delay of the gate lines and the data lines are overcome completely.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A method for reducing double images of a frame, said frame being divided into a plurality of regions and being provided by a display device, the display device having a gate driver, a plurality of source drivers, a plurality of data lines and a plurality of gate lines, the method comprising:

generating a plurality of output enable signals for adjusting a plurality of conduction durations of the gate lines of the corresponding regions;

outputting the output enable signals to the gate driver for generating a plurality of scan signals of the corresponding regions, wherein a plurality of waveforms of the scan signals are modulated by the output enable signals, at least two of the adjacent respective output enable signals have respectively different pulse widths and different rising edges, the different rising edges indicate that the adjacent respective output enable signals each takes a different period of time to change from deactivation to activation, the plurality of scan signals have respectively different conduction durations; and driving the gate lines of the corresponding regions by the gate driver according to the scan signals.

2. The method of claim 1, wherein the output enable signals are utilized to reduce the conduction durations of the gate lines of the corresponding regions by shortening the waveforms of the scan signals are shorten.

3. The method of claim 2, wherein the reduction of the conduction durations is done by delaying conducting and/or early shutting down the gate lines.

4. The method of claim 1, wherein each of the output enable signals is utilized to adjust the conduction durations of all the gate lines of one corresponding region among the regions.

5. The method of claim 1, wherein each of the output enable signals is utilized to adjust a conduction duration of one corresponding gate line among the gate lines.

6. The method of claim 1, further comprising:

generating a plurality of latch data signals for adjusting a data output time of the data lines of the regions;

outputting the latch data signals to the source drivers for generating a plurality of pixel data signals of the corresponding regions; and driving the data lines of the corresponding regions by the source drivers according to the pixel data signals.

7. The method of claim 6, wherein the adjustment of the data output time is done by delaying the data output time.

8. A method for reducing double images of a frame, the frame being divided into a plurality of regions and being provided by a display device, the display device having a gate driver, a plurality of source drivers, a plurality of data lines and a plurality of gate lines, the method comprising:

generating a plurality of latch data signals for adjusting a plurality of data output times of the data lines of the regions;

outputting the latch data signals to the source drivers for generating a plurality of pixel data signals of the corresponding regions, wherein a plurality of waveforms of the pixel data signals are modulated by the latch data signals, at least two of the adjacent respective latch data signals have respectively different pulse widths and different rising edges, the different rising edges indicate that the adjacent respective output enable signals each takes a different period of time to change from deactivation to activation, the plurality of pixel data signals have respectively different data output times; and driving the data lines of the corresponding regions by the source drivers according to the pixel data signals.

9. The method of claim 8, wherein the adjustment of the data output time is done by delaying the data output time.

10. The method of claim 8, wherein the regions comprise a plurality of vertical regions of the frame.

11. The method of claim 8, wherein each of the source drivers adjusts all the data lines of the corresponding region according to the corresponding latch data signal of the latch data signals.

12. The method of claim 8, further comprising:

generating a plurality of output enable signals for adjusting a plurality of conduction durations of the gate lines of the corresponding regions;

outputting the output enable signals to the gate driver to generate a plurality of scan signals of the corresponding regions; and driving the gate lines of the corresponding regions by the gate driver according to the scan signals.

13. The method of claim 12, wherein each of the output enable signals is utilized to reduce the conduction durations of the gate lines of one corresponding region among the regions.

14. The method of claim 12, wherein each of the output enable signals is utilized to adjust the conduction duration of one corresponding gate line among the gate lines.

* * * * *